United States Patent [19]

Feldman et al.

[11] 4,036,349

[45] July 19, 1977

[54] COMBINED MECHANISM FOR IMPACTING A PRINT MEMBER AND ADVANCING A PRINTING RIBBON

[75] Inventors: Edward Feldman, Teaneck; George Lupinacci, Nutley, both of N.J.

[73] Assignee: Sweda International, Inc., Pinebrook, N.J.

[21] Appl. No.: 554,002

[22] Filed: Feb. 28, 1975

[51] Int. Cl.[2] ..... B41J 33/22; B41J 33/32

[52] U.S. Cl. ..... 197/151; 197/55; 101/93.43; 101/107

[58] Field of Search ..... 197/52–55, 197/151; 101/107, 336, 93.43, 93.24, 93.25

[56] References Cited

U.S. PATENT DOCUMENTS

| | | | |
|---|---|---|---|
| 3,378,127 | 4/1968 | Clary et al. | 197/55 |
| 3,503,483 | 3/1970 | Santo | 197/151 |
| 3,532,204 | 10/1970 | Sasaki | 197/82 |
| 3,665,855 | 5/1972 | Nikoloff | 197/151 |
| 3,763,988 | 10/1973 | Kuramochi | 197/151 |
| 3,827,543 | 8/1974 | Kawano et al. | 197/55 |
| 3,878,782 | 4/1975 | Coffelt | 101/244 |

*Primary Examiner*—Edgar S. Burr
*Assistant Examiner*—William Pieprz
*Attorney, Agent, or Firm*—Robert F. Rotella; Norman Friedman

[57] ABSTRACT

A combined mechanism for impacting a print member and advancing a printing ribbon of a high speed printer wherein an electromagnet, located near and on a yoke mechanism containing the print stem shaft of the print head, operate together with a linkage mechanism which is attached to the yoke mechanism, to impact the print head upon a platen and advance a printing ribbon one increment, the linking mechanism including several linking members and a stop which allows free movement to a first linking member and a cable which during energization is drawn taut but goes slack during de-energization and remains slack after the print head impacts and rebounds to a neutral position.

7 Claims, 2 Drawing Figures

COMBINED MECHANISM FOR IMPACTING A PRINT MEMBER AND ADVANCING A PRINTING RIBBON

BACKGROUND OF THE INVENTION

In printing mechanisms and particularly high speed printing mechanisms it is very important to have a mechanism that will function at such high speeds to properly impact the print head and advance the printing ribbon. As the machanism is operating at high speeds and prints on the fly, it is necessary to have a simple mechanism which can operate reliably and quietly at these high speeds.

Modern printing type heads are usually powered by separate print impact mechanisms usually powered by cyclically driven mechanical devices for effecting the printing stroke thereof such as described in U.S. Pat. No. 3,461,996, Reed Operated Printer. Such printing is effected therein by the potential energy stored within a resilient power reed as deflected by the energization of an electromagnet located away from the print stem shaft of the print head. Such reed deflection imparts movement to a steel tape coupled to a pulley arranged on a slide block which accelerates the printing head to strike a printing ribbon. This printing is effected upon the energizing of the electromagnet by an electronic impulse signal as received from a conventional control machine.

SUMMARY OF THE INVENTION

An improved combined mechanism for impacting a print member and advancing a printing ribbon of a high speed printer wherein an electromagnet, having a stator fixed to a supporting member, and an armature located near and on a yoke mechanism containing the print stem shaft of te print head, operate together with an elongated, first linkage mechanism which is attached to the yoke mechanism, and a second link member connected to a one-way clutch, the links being connected together by a flexible cable, to impact the print head upon a platen and advance a printing ribbon one increment.

An object of the invention is to provide an improved ribbon advance mechanism which is quiet and reliable in operation.

Another object of the invention is to provide an improved combined print impact mechanism and ribbon advance mechanism which is simple, reliable and quiet.

It is a still further object of the invention to provide an improved ribbon advance mechanism which utilizes the kinetic energy of the returning print impact mechanism to advance the printing ribbon one increment.

These and other objects, advantages, features and uses will be apparent from the following more particular description of the preferred embodiment of the invention as illustrated in the accompanying drawings, wherein;

DETAILED DESCRIPTION OF THE INVENTION

Figure 1:
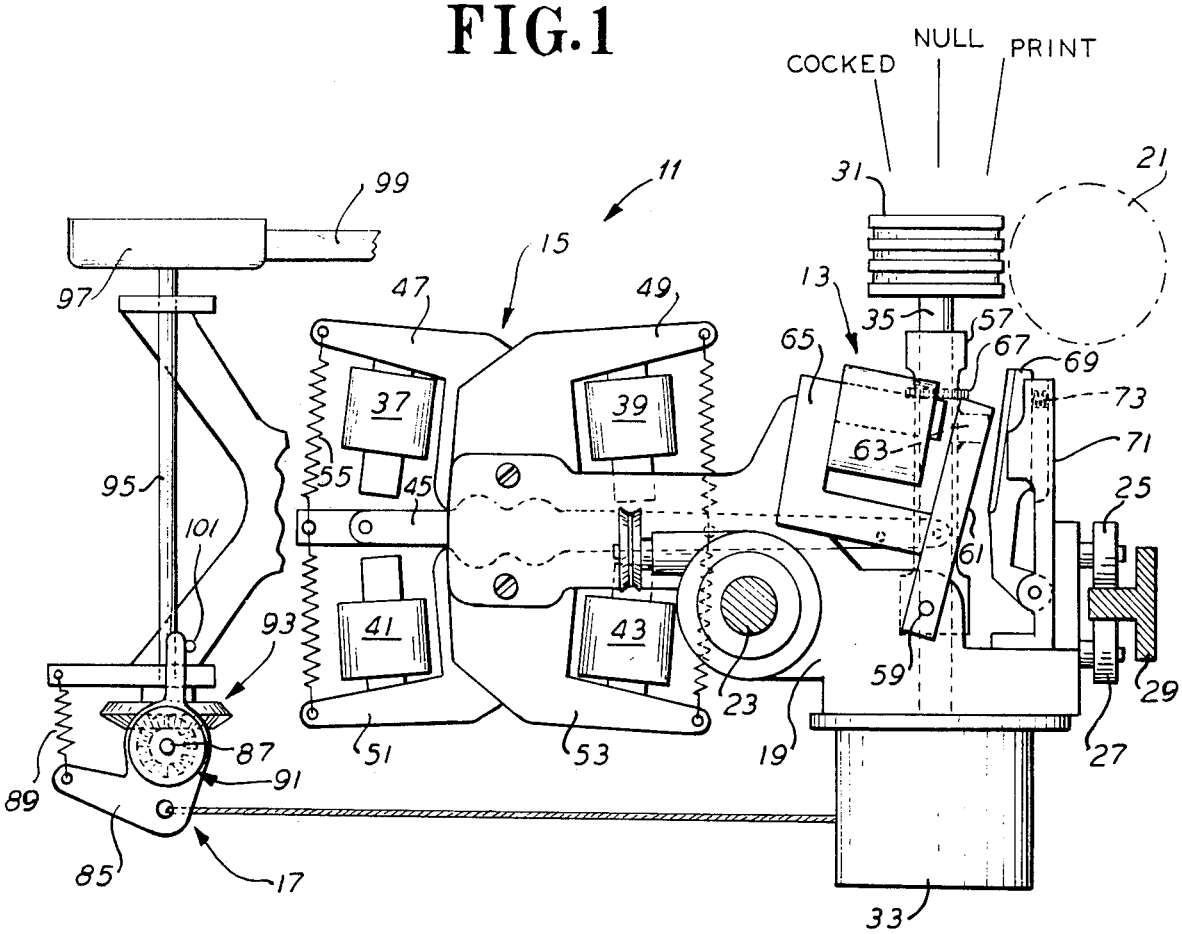
FIG. 1 illustrates a simplified, partly schematic left side view of the combined print impacting and ribbon advancing mechanism of the invention.

Referring now to FIG. 1 the serial printing unit 11 comprises three assemblies; print impact mechanism 13, print head positioning mechanism 15 and ribbon advance mechanism 17 all located on an overall support member 19, a supporting and transporting member. The entire unit is constructed to be transported horizontally along the printing platen (shown by dotted circle 21). It is conventionally supported in this movement by shaft 23, which is part of the supporting structure of the printer and above which it moves by rollers 25 and 27, which ride on rail 29 which is also part of the supporting structure of the printer.

The mechanism to transport the print head mechanism 15 along the platen 21 and the mechanism to rotate a print head 31 by use of a stepping motor 33 are all described in detail in said U.S. Pat. No. 3,461,996, Reed Operated Printer. The mechanism to shift the print head 31, 15, is described in detail in U.S. Pat. No. 3,743,073, Print Head Shifting Mechanism.

Now, briefly describing the operation of these mechanisms before going into a detailed description of the print impact and ribbon advance mechanisms of this invention; the stepping motor 33 rotates a four band print head 31 about the axis of a print stem shaft 35 to align the proper vertical column of letters with the printing position. Suitable mechanism is also provided (not shown) to move the entire mechanism along the platen by a suitable tape and pulley mechanism described in detail in the first aforementioned patent; by pulling a tape the entire printing unit 11 can be shifted along the platen 21.

As aforementioned, stepping motor 33 rotates print stem shaft 35 to bring the proper column of type faces on the print head 31 into printing position. It is also to be noted that there is a suitable ball and socket or other coupling between the stepping motor print shaft and print stem shaft 35. For example, see FIG. 7 of the first aforementioned patent. This coupling is located so that the print head 31 and print stem shaft 35 can move in free flight and still be indexed by the stepping motor 33.

The print head shift mechanism 15 consists of four electromagnets 37, 39, 41, and 43 which co-act with a first member, a center linkage 45 and are supported by U-shaped members 47, 49, 51, and 53. Extending from an opening in these U-shaped members 47, 49, 51, and 53 to the center linkage 45 are springs 55. These springs are balanced so as to keep the central linkage 45 in a central position spaced equidistantly from the heads of the electromagnets. The center linkage itself consists of several elongated members, described in detail in the second aforementioned patent. The center linkage 45 is connected to print stem shaft 35 by suitable coupling means such as shown in FIG. 4 of the said patent.

By the actuation of these four electromagnets 37–43 and the use of the center linkage 45, all four bands of the printing head 31 can quickly be brought into alignment with the printing platen 21. To assist in this movement four springs 55 are provided. These springs 55 are balanced so that they exert the same force on respective sides of the center linkage 45. This will cause the center linkage 45 to always return to its central position when all four electromagnets 37–43 are not actuated.

In operation however, as one electromagnet is actuated the spring alongside its opposing electromagnet (on the other side of the central linkage) will be stretched to impart potential energy to it. If for example electromagnet 41 is actuated, spring 55 alongside the electromagnet 37 will be stretched and thereby have potential energy imparted to it. Then when electromagnet 37 is actuated and electromagnet 41 is deactuated, the potential energy in the spring will assist in moving the central linkage towards electromagnet 37 and away from electromagnet 41 thereby increasing the speed of operation of the mechanism.

Now referring to the inventive features of this invention, the print impact mechanism 13 and the ribbon advance mechanism 17. The print impact mechanism 13 comprises a vertically oriented yoke 57 which is pivotably attached about a shaft 59 within support member 19. This yoke 57 holds the print head 31 is position allowing it to freely rotate and move up and down. Print stem shaft 35 on which the print head 31 is mounted passes through an opening in said yoke 57, and is supported within said yoke 57, to said stepping motor 33. A rectangular armature member 61, which is constructed of magnetically attractable iron, is fixedly attached at one end to yoke 57, by an outwardly extending tab 63 perpendicular to yoke 57, and pivotably attached at its other end about shaft 59 thereby remaining fixed with respect to said yoke 57 and print stem 35. In operative relationship to said armature 61 is a U-shaped electromagnet stator 65, fixedly connected to said support member 19. Axially attached to said print stem shaft 35 and within said yoke 57 is a serrated wheel 67 having the same number of teeth as the number of characters on any one band of the print head 31. Vertically oriented, and pivotably coupled to the support member 19 is a detent member 69 whose back edge fits within a slotted bracket member 71, which is also fixedly attached to said support member 19. Within the upper portion of the slot of said bracket member 71 is a horizontally oriented, small spring 73, attached at one end to the back wall of said slot and at its front end to the back edge of said detent member 71. The front edge of said detent member 69 is blade shaped so as to loosely fit within said teeth of said serrated wheel 67 and is sloped several degrees off the vertical.

Figure 2:
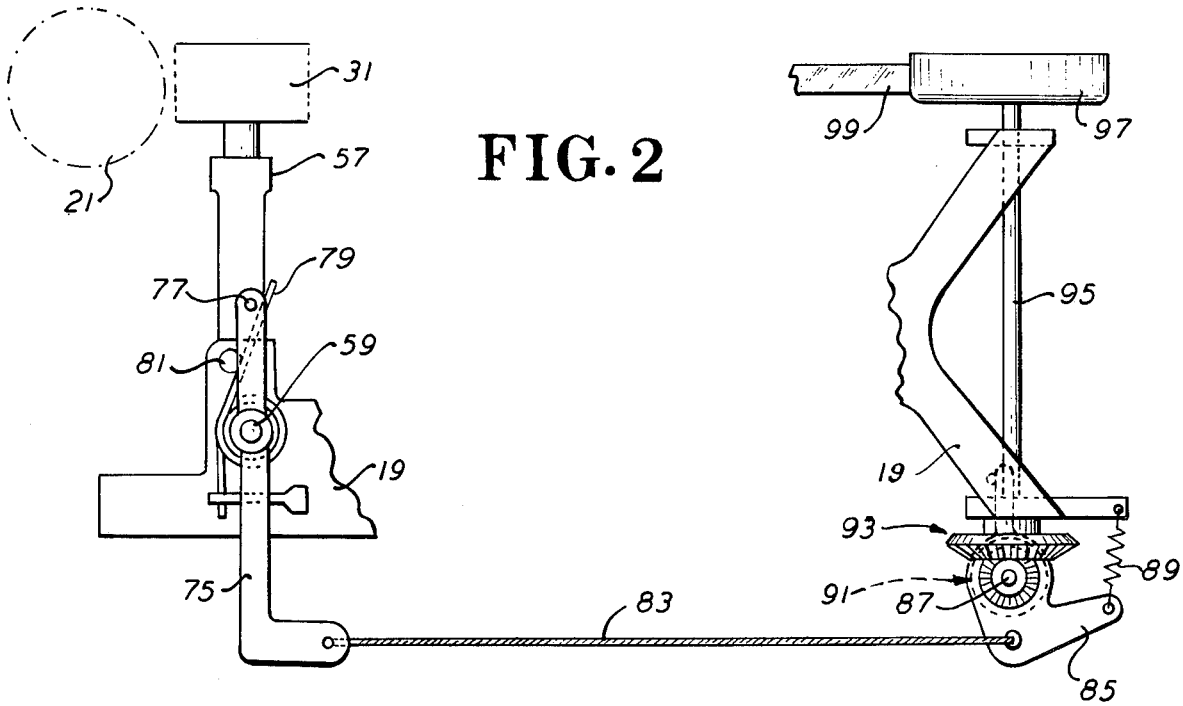
FIG. 2 is a partial, right side view of the combined mechanism, without the print head positioning mechanism shown, of FIG. 1.

Referring now also to FIG. 2, the ribbon advance mechanism 17 comprises an elongated rectangular link member 75 which is pivotably mounted near its upper portion on shaft 59 and fixedly attached to and separated from the movable yoke 57 by a first pin 77 extending outwardly from the side of the yoke 57 and perpendicular to its longitudinal axis, to the upper end of said link member 75. The lower end of said link member 75 extends until about half-way down the casing of the stepper motor 33. Wound around the shaft 59, between the support member 19 and said link member 75 is a torsion spring 79, one end of which is positioned by an outwardly extending, short pin 81, fixed perpendicular to a side wall of the support member 19, situated so as to only engage said first pin 77 when said print head 31 moves from a vertical or null position away from said platen 21 into a "cocked" position. A short, flexible ribbon advance cable 83 is fixed at one end to the lower end of said link member 75 and at its other end to the front end of a ribbon advance arm 85 which is rotatably mounted on the front end of an inwardly extending shaft 87 which is oriented perpendicular to said support 19. The tail end of said ribbon advance arm 85 is attached to one end of a vertically oriented spring 89 whose other end is fixed to said support member 19. The other end of shaft 87 is in turn coupled to a one-way clutch 91 whose output shaft is coupled to a conventional bevel gear train 93 which drives a long, vertical, ribbon drive shaft 95. This drive shaft 95 is connected to a conventional ribbon container 97 which holds a spool (not shown) for takingup any printing ribbon 99 which is wound thereon. This ribbon 99 is fed from a similar, symetrically placed and mounted, conventional container assembly (not shown), which is located on the other side of the supporting member 19, and which holds a spool of tape, and through conventional guides means (not shown) properly positions the tapee 99 between the print head 31 and the platen 21.

Basically the operation of the two mechanisms 13 and 17 are as follows: When the electromagnet 65 is energized, the armature 61 is attracted to the electromagnet 65, pivoting the yoke 57 and the print head 31 contained therein, about pivot point 59, from its vertical or null position to said cocked position, in this embodiment three degrees off the vertical. This action compresses torsion spring 79 and draws the ribbon advance cable 83 taut. When the print head 35 is fully positioned, in the cocked position, the electromagnet 65 is de-energized. The yoke 57 with the print head 31 is then driven toward the platen 21 by the compressed torsion spring 79. Before reaching the platen 21, or engaging the detent 69, the print stem shaft 35, goes into free flight when it reaches the null position. Prior to impacting the platen 21, the serrated wheel 67 on the print stem shaft 35 enters detend 69 which provides several functions; angular registration of the print head 31 and compensation for the variation in print wheel inertia at the four different band levels thereby maintaining a constant impact velocity and uniform print impression. This compensation is achieved by providing a sloping front edge to the detent 69 which results in the detent 69 being engaged earlier at the lower band levels. As the yoke 57 and print head 31 pivot from the cocked position toward the neutral or null position the ribbon advance cable 83 tends to go slack but spring 89 drives the ribbon advance arm 85 thereby maintaining the cable 83 taut but without advancing the ribbon drive shaft 95. When the print head 31 reaches the neutral position, the print head 31 is in free flight and some slack is introduced into the ribbon advance cable 83. Since the ribbon advance arm 85 is coupled to the ribbon drive shaft 95 by a one-way clutch 91, the ribbon drive shaft 95 is prevented from being driven any further.

After the print head 31 impacts the platen 21, it rebounds to the neutral position; the ribbon advance cable 83 remains slack during such period. The reason the ribbon advance cable 83 is maintained slack is because when the print head 31 impacts the platen 21 and rebounds any drag on the print stem 35 is decreased thereby allowing it to enter and leave the detent 69 as quickly as possible and once the print stem 35 is out of the detent 69 it can be properly rotated resulting in a faster printing cycle.

When the print head 31 rebounds to the neutral position the electromagnet 65 is energized thereby attracting armature 61 fixed to the yoke 57 resulting in a retraction of the print stem shaft 35 and print head 31 as well as compressing the torsion spring 79. Simultaneously the ribbon advance cable is drawn taut by the ribbon advance link member 75 which is attached to said yoke 57 thereby driving the ribbon advance arm 85 which in turn drives the ribbon shaft 95 through the one way clutch 91 thereby advancing the ribbon 99 one increment. Such later action also tends to slow down the armature 61 before it contacts the electromagnet 65 reducing the impact noise level.

Suitable conventional drive circuits controlled by a master control means, neither deemed necessary to be set forth, may be utilized to properly control the energization and de-energization of the electromagnet 65.

Obviously many modifications and variations of the present invention are possible in light of the above teachings. It is therefore to be understood that within the scope of the appended claims the invention may be practiced otherwise than specifically described.

What is claimed is:

1. A device for impacting a print member and advancing a printing ribbon comprising:

print means comprising a rotatable print member having a plurality of print bands thereon and having null, cocked, and print positions, yoke means for supporting said print member therein, support means having said yoke means rotatably mounted thereon, electromagnetic means having a stator and an armature, said stator being mounted on said support means and said armature being coupled to said yoke means, for actuating said print means thereby causing said print member to impact, a ribbon advance means coupled to said yoke means, for advancing said ribbon one increment each time said electromagnetic means is energized, said ribbon advance means including a first elongated link member;

said first link member having an upper end and a lower end, said upper end being pivotably coupled to said yoke means;

a second link member pivotably coupled to said supporting means, one-way clutch means, connected to and driven by said second link member, for moving said printing ribbon in only one direction, and a flexible cable connecting means, coupled to said first and second link members, wherein said first link member is rotated in a first direction, said flexible cable connecting means is drawn taut, and said second link member is rotated in a first direction, whereby said one-way clutch means is engaged thereby advancing said ribbon one increment when said electromagnetic means is energized, wherein said first link member is rotated in a second direction, opposite to said first direction, said flexible cable connecting means goes slack, and said second link member is rotated in said second direction, when said electromagnetic means is de-energized, and wherein said first link member is rotated in said first direction, said flexible cable connecting means remains slack, and said second link member remains stationary, after said print member impacts.

2. The device according to claim 1 further including:

mounting means, coupled to said first link means, for mounting said first link means to said yoke means.

3. The device according to claim 2 wherein said mounting means includes, a first connecting means, fixedly connecting the upper end of said first link means to said yoke means.

4. The device according to claim 3 further including, stop means, fixedly connected to said support means and extending therefrom towards said first link member, for allowing rotatable movement of said first link member, and spring means, wound around said first link member's pivot point, one end of which engages both surfaces of said first connecting means and said stop means when said print means is in its null position, for engaging said first connecting means only when said print member is rotated from said null position to said cocked position.

5. The device according to claim 4 wherein said first link member includes a tab means at its lower end to which said flexible cable connecting means are attached.

6. The device according to claim 5 wherein said second link member has a forward and end portion, and wherein said forward section is attached to said flexible cable connection means, and further including print means, one end of which is connected to said end section of said second link means and the other end of which is connected to said support means.

7. The device according to claim 6 wherein said stop means comprises a pin shaped element, one end of which is fixedly connected to said yoke means and perpendicular to yoke means.

* * * * *

UNITED STATES PATENT AND TRADEMARK OFFICE

CERTIFICATE OF CORRECTION

PATENT NO. : 4,036,349

DATED : July 19, 1977

INVENTOR(S) : Edward Feldman

It is certified that error appears in the above-identified patent and that said Letters Patent are hereby corrected as shown below:

Column 1, line 11, "machanism" should be --mechanism-- line 38, "te" should be --the--

Column 3, line 15, "is" should be --in--

Column 4, line 12, "tapee" should be --tape-- line 29, "detend" should be --detent-- line 66, after ribbon insert --drive--

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*